US006191078B1

(12) United States Patent
Shlomo et al.

(10) Patent No.: US 6,191,078 B1
(45) Date of Patent: Feb. 20, 2001

(54) PART-SYNTHETIC, AVIATION PISTON ENGINE LUBRICANT

(75) Inventors: Antika Shlomo, Maplewood; Frederick W. Girshick, Scotch Plains, both of NJ (US); Patrick Edward Godici, Baton Rouge, LA (US); Richard A. Skillman, Brights Grove (CA)

(73) Assignee: ExxonMobil Research and Engineering Company, Annandale, NJ (US)

( * ) Notice: Under 35 U.S.C. 154(b), the term of this patent shall be extended for 0 days.

(21) Appl. No.: 09/399,652

(22) Filed: Sep. 21, 1999

(51) Int. Cl.[7] ..... C10M 133/16; C10M 133/56

(52) U.S. Cl. ..... 508/273; 508/280; 508/291; 508/294

(58) Field of Search ..... 508/273, 291, 508/294, 280

(56) References Cited

U.S. PATENT DOCUMENTS

| | | | | |
|---|---|---|---|---|
| 3,405,064 | | 10/1968 | Miller | 252/51.5 |
| 3,798,166 | | 3/1974 | Braid | 252/51.5 |
| 3,926,823 | | 12/1975 | Durr et al. | 252/49.9 |
| 3,931,022 | | 1/1976 | Chesluk et al. | 252/47.5 |
| 5,049,292 | | 9/1991 | Grasshoff et al. | 252/49.6 |
| 5,094,763 | | 3/1992 | Tochigi et al. | 252/46.6 |
| 5,387,346 | * | 2/1995 | Hartley et al. . | |
| 5,516,440 | | 5/1996 | Dasai et al. | 252/32 |
| 5,578,236 | | 11/1996 | Srinivasan et al. | 508/188 |
| 5,641,732 | * | 6/1997 | Bloch et al. . | |
| 5,641,733 | * | 6/1997 | Bloch et al. . | |
| 5,646,099 | * | 7/1997 | Watts et al. . | |
| 5,858,932 | * | 1/1999 | Dasai et al. . | |
| 5,866,519 | * | 2/1999 | Watts et al. . | |
| 5,942,472 | * | 8/1999 | Watts et al. . | |
| 6,060,437 | * | 5/2000 | Robson et al. . | |

FOREIGN PATENT DOCUMENTS

| | | | |
|---|---|---|---|
| 2170509 | 8/1986 | (GB) | C10M/141/10 |

* cited by examiner

*Primary Examiner*—Jerry D. Johnson
(74) *Attorney, Agent, or Firm*—Joseph J. Dvorak

(57) ABSTRACT

An aviation piston engine lubricant having no metal containing additive is provided. The lubricant contains (a) a base oil consisting essentially of a mixture of (i) at least about 50 wt % based on the total weight of the lubricant of one or more mineral oils having a viscosity in the range of about 5 cSt to about 25 cSt at 100° C. and (ii) about 15 to about 40 wt % based on the total weight of the lubricant of a polyalpha olefin fluid having a viscosity in the range of about 4 cSt to about 40 cSt at 100° C.;

(b) at least about 3 wt % based on the total weight of the lubricant of an ashless polyisobutylene succinic anhydride/polyamine (PIBSA/PAM) dispersant; and (c) an effective amount of one or more ashless additives selected from the group consisting of antiwear agents, extreme pressure agents, metal passivators, and antioxidants.

9 Claims, No Drawings

PART-SYNTHETIC, AVIATION PISTON ENGINE LUBRICANT

FIELD OF INVENTION

The present invention relates to a lubricating composition for aviation piston engines. More particularly the present invention is directed toward a part synthetic aviation piston engine lubricant.

BACKGROUND OF INVENTION

Lubricating oils have been used in internal combustion engines, power transmission components, shock absorbers, power steering devices and the like. Crank case lubricants, i.e., oils for internal combustion engines, are formulated to perform a number of functions. The most important of these is to reduce friction on and wear of the engines pistons, valves, rings and the like. Engine oils also are formulated to protect metal surfaces against rust and corrosion, to provide oxidation stability, minimize deposits, and to flush out contaminants.

The performance of lubricant oils is a function of the additive composition they contain. The most common types of additives are: antiwear agents, extreme pressure (EP) agents, antifoams, antioxidants, detergents, dispersants, viscosity-index improvers, rust inhibitors, corrosion inhibitors, friction modifiers, and pour point depressants.

Unfortunately the effectiveness of any combination of additives cannot be predicted because of factors such as physical and chemical compatibility, for example. Also, while a given lube additive may contribute to the enhancement of one property of the lubricant composition often it has a negative impact on another property of the lubricant composition.

Among the many additives that are used in automotive engine lubricants are zinc compounds such as zinc dialkyldithiophosphate, molybdenum compounds such as molybdenum dithiocarbamate, calcium salts such as calcium sulfonate and borated compounds such as borated hydrocarbon-substituted succinic acid compounds. Because these additives produce ash deposits when used in internal combustion engines, they cannot be used in aviation piston engine lubricant compositions. Thus, one object of the present invention is to provide a lubricating composition for aviation piston engines that does not contain ash forming additives.

Another object of this invention is to provide a lubricating oil for aviation piston engines that has enhanced oxidative and thermal stability with sufficient solvency for fuel degradation products thereby reducing undesirable engine deposits.

Additional objects and advantages will be set forth in or will be obvious from the discussion of the invention.

SUMMARY OF INVENTION

In accordance with the invention there is provided an aviation piston engine lubricant having no metal-containing additive content, the lubricant comprising:

(a) a base oil consisting essentially of a mixture of (i) at least about 50 wt % based on the total weight of the lubricant of one or more mineral oils having a viscosity in the range of about 5 cSt to about 25 cSt at 100° C.;

(ii) about 15 to about 40 wt % based on the total weight of the lubricant of a polyalpha olefin fluid having a viscosity in the range of about 4 cSt to about 40 cSt at 100° C.;

(b) at least about 3 wt % based on the total weight of the lubricant of an ashless polyisobutylene succinic anhydride/polyamine (PIBSA/PAM) dispersant; and (c) an effective amount of one or more of ashless additives selected from the group consisting of antiwear agents, extreme pressure agents, metal passivators and antioxidants.

In another embodiment, the lubricant of the present invention includes a sufficient amount of a viscosity improver (VI) to provide the lubricant with a multi-grade viscosity.

Other embodiments will be apparent from the detailed description which follows.

DETAILED DESCRIPTION OF THE INVENTION

A. The Base Oil

Mineral Oil Basestock

The mineral oil basestock used in the base oil may be selected from any of the natural mineral oils of API Groups I, II, III or mixtures of these used in lubricating oils for spark-ignited engines. Preferably, the mineral basestock is a Group I basestock or basestock blend having the properties shown in Table 1.

An especially preferred basestocks comprise a mixture of a solvent extracted mineral oil and solvent extracted bright stock. Typically these are combined in amounts such as those shown in Table 1 to meet preselected viscosity grades.

Typically the mineral oil basestock will comprise at least 50 wt % of the lubricant, for example from about 50 to about 75 wt % and preferably 60 to 75 wt %.

(ii) The Polyalpha Olefin Fluid

The polyalpha olefin (PAO) fluid used in the base oil may be selected from any of the olefin oligomer oils used in lubricants. In general the PAO will have a viscosity at 100° C. in the range of about 4 cSt to about 40 cSt and preferably about 4 cSt to about 10 cSt. Preferably the polyalpha olefin is one having the properties shown in Table 2.

TABLE 1

| | Mineral Basestock | | | | Mineral Basestock Blends | | |
|---|---|---|---|---|---|---|---|
| | Solvent Extracted 150N | Solvent Extracted 325N | Solvent Extracted 600N | Solvent Extracted Bright Stock | For SAE 10W-50 | For SAE 15W-50 | For SAE 20W-50 |
| Composition | | | | | | | |
| S150N (wt %) | | | | | 60 | | |
| S600N (wt %) | | | | | 40 | 90 | 55 |
| Bright Stock (wt %) | | | | | | 10 | 45 |
| Kinematic Viscosity | | | | | | | |

TABLE 1-continued

| | Mineral Basestock | | | | Mineral Basestock Blends | | |
|---|---|---|---|---|---|---|---|
| | Solvent Extracted 150N | Solvent Extracted 325N | Solvent Extracted 600N | Solvent Extracted Bright Stock | For SAE 10W-50 | For SAE 15W-50 | For SAE 20W-50 |
| (ASTMD445) | | | | | | | |
| @ 100° C., cSt | 5.0–5.4 | 8.1–8.6 | 11.7–12.5 | 30–33 | 7.1 | 13.2 | 18.1 |
| @ 40° C., cSt | 29–31 | 62–67 | 110–116 | 440–500 | 49 | 128.5 | 207 |
| Pour Point (ASTM D97), ° C. | −9 | −9 | −9 | −9 | −9 | −9 | −9 |
| Specific Gravity @ (15.6/15.6° C.) | 0.868–0.878 | 0.872–0.884 | 0.879–0.890 | 0.893–0.908 | 0.877 | 0.886 | 0.890 |

TABLE 2

| | POLYALPHA OLEFIN | | | | |
|---|---|---|---|---|---|
| Properties | PAO-4 | PAO-6 | PAO-8 | PAO-10 | PAO-40 |
| Kinematic Viscosity (ASTM D445) | | | | | |
| @ 100° C., cSt | 4.0 | 6.0 | 8.0 | 10.0 | 40.0 |
| @ 40° C., cSt | 17.0 | 31.5 | 46.5 | 62.5 | 39.5 |
| @ −40° C., cSt | 2500 | 8000 | 19000 | 32000 | — |
| Pour Point (ASTM D97), ° C. | −70 | −68 | −63 | −53 | −34 |
| Specific Gravity @ (15.6/15.6° C.) | 0.820 | 0.830 | 0.835 | 0.840 | 0.840 |

Typically the PAO will comprise from about 15 to about 40 wt % of the lubricant and preferably from about 20 to about 30 wt %.

B. The Ashless Dispersant

The lubricant composition also includes at least about 3 wt % based on the total weight of the lubricant of a polyisobutylene-succinic anhydride/polyamine (PIBSA/PAM) ashless dispersant. Preferably the lubricant contains 3 wt % to about 6 wt % and more preferably 4 wt % of the PIBSA/PAM.

PIBSA/PAM dispersants are polyamino alkenyl or alkyl succinimides which are the reaction product of an alkenyl- or alkyl-substituted succinic anhydride and a polyalkenyl polyamine. The aliphatic substituted succinic acids or anhydrides are those materials bearing aliphatic groups containing from 20 to 200 carbons, preferably 20 to 100 carbons, most preferably 50 to 70 carbons, the aliphatic group, consequently being of from about 280 to 2800 molecular weight most preferably about 700 to 1000 molecular weight wherein the aliphatic substituent are usually olefin homopolymers or copolymers, e.g. homopolymers or copolymers, of ethylene, propylene butylene, isobutylene, etc. Thus, a typical aliphatic substituted succinic acid or anhydride is polyisobutylene succinic acid or anhydride (PIBSA) wherein the polyisobutylene moiety ranges from about 280 to 2800 molecular weight, most preferably about 700 to 1000 molecular weight.

The polyalkenyl polyamine (PAM) portion of the dispersant molecule may be composed of varying alkene type and oligomer chain length. Tetraethylene pentamine is commonly used in this synthesis.

The ashless dispersant would be available from additive suppliers typically at 50% active ingredient concentration, with the remainder being a low viscosity mineral oil.

The ashless dispersant can also provide strong protection against rust. To accomplish that some level of weak acidity (measured by ASTM D664) is desirable.

The ashless dispersant (after dilution) should have a nitrogen concentration of 1% to 2.2%, preferably 1.4 to 1.8%, most preferably around 1.6%. The acid number (ASTM D664-Buffer B end-point) should be from 4 to 9, preferably from 5 to 8.

C. Ashless Additives

The lubricant composition preferably includes one or more ashless additives selected from the group consisting of antiwear agents, extreme pressure agents, metal passivators, and antioxidants. Indeed it is especially preferred to include in the lubricant 0.5 to 3.0 wt % of tricresyl phosphate as the antiwear agent; however, other antiwear agents of the same chemical family of alkylated aryl phosphates are also useful.

For antioxidants an aryl amine antioxidant such as alkylated diphenyl amine and hindered phenol antioxidants and mixtures thereof are preferred. The amine is typically present in about 0.2 to 2.0 wt % and the phenol, in about 0.1 to 2.0 wt %.

A dimercapto thiadiazole alkyl derivative is the preferred extreme pressure agent. Typically it is used in the lubricant in the range of about 0.02 to 0.5 wt %.

Benzotriazole derivatives are useful in the lubricant composition as a metal passivator. Indeed, a particularly preferred lubricant includes about 0.01 to 0.2 wt % of tolyltriazole.

D. VI Improver

For multigrade lubricants the lubricant of the invention will include a viscosity index (VI) improver in an amount sufficient to provide a preselected multi viscosity grade such as SAE 15W-50, 20W-50, 25W-60 and the like. Among suitable VI improvers are hydrogenated ethylene-propylene, styrene-isoprene, and styrene-butadiene copolymers, polyalkylacrylates and the like. Functionalized versions of such polymers to impart dispersant properties to the VI improver may also be used.

E. Pour Point Depressant

If needed to meet specific pour point requirements, the lubricant will contain a pour point depressant in an amount sufficient to meet that requirement. Among suitable pour point depressants are polymethacrylates and dialkyl fumarate-vinyl acetate copolymers.

F. Anti Foamant

The lubricant of this invention also may contain from 0 to 20 ppm of an antifoam agent such as a silicone oil antifoamant.

The advantages of this invention are illustrated by the following examples.

EXAMPLES 1 AND 2

Aviation piston engine lubricants were prepared by blending together the components listed in Table 3 (Example 1) and Table 4 (Example 2) in the proportions specified.

TABLE 3

| Component | Concentration (By Weight) |
|---|---|
| Solvent Extracted 600 N Base Oil | 32.4% |
| Solvent Extracted Bright Stock | 26.95% |
| 6 cSt PAO ® | 26.0% |
| Paratone ® 8022[1] (VI Improver and Pour Point Depressant) | 8.0% |
| Parabar ® 9201[2] (PIBSA/PAM Dispersant) | 4.0% |
| Durad ® 125[3] (Tricresyl Phosphate) | 1.5% |
| Naugalube ® 438 L[4] (Amine Antioxidant) | 0.6% |
| Irganox L ® 135[5] (Phenolic Antioxidant) | 0.3% |
| Hitec ® 4313[6] (dimercaptothiadiazole extreme pressure agent) | 0.2% |
| Cobratec ® TT-100[7] (Tolyltriazole) | 0.05% |
| ECA ® 8991[8] (Silicone Antifoam Solution) | 0.002% |

[1]is a product of Oronite Corp., San Francisco, CA.
[2] and [8]are products of Infineum Corp., Linden, NJ.
[3]is a product of FMC Corp., Philadelphia, PA.
[4]is a product of Uniroyal Corp., Middleburry, CT.
[5]is a product of Ciba-Geigy, Greensboro, NC.
[6]Hitec is a product of Ethyl Corp., Baton Rouge, LA.
[7]is a product of PMC, Cincinnati, OH.

TABLE 4

| Component | Concentration (By Weight) |
|---|---|
| Solvent Extracted 600 N Base Oil | 32.4% |
| Solvent Extracted Bright Stock | 26.95% |
| 6 cSt PAO | 26.0% |
| Paratone ® 8022 (Pour Depressed VI Improver) | 8.0% |
| Parabar ® 9201 (PIBSA/PAM Dispersant) | 4.0% |
| Syn-O-Ad ® 8484[1] (Tricresyl Phosphate) | 1.5% |
| OA ® 501[2] (Amine Antioxidant) | 0.6% |
| Naugalube ® 531[3] (Phenolic Antioxidant) | 0.3% |
| Hitec ® 4313 (dimercaptothiadiazole extreme pressure agent) | 0.2% |
| Cobratec ® TT-100 (Tolyltriazole) | 0.05% |
| ECA ® 8991 (Silicone Antifoam Solution) | 0.002% |

[1]is a product of Akzo Noble Chemical, Amersfoort, Netherlands
[2]is a product of Keil Chemical Division of Ferro Corp., Hammond, IN
[3]is a product of Uniroyal Corp., Middlebury, CT

EXAMPLES 3 TO 5 AND COMPARATIVE EXAMPLE 1

These examples illustrate the importance of the dispersant. Three oils were formulated with the same components as Example 1 except none contained Hitec 4313. Also the oils of Examples 3 to 5 contained 3 wt %, 4 wt % and 5 wt % respectively of Parabar 9201. The oils were mixed with 10% carbon black paste and increase in kinematic viscosity at 100° C. for each was determined. A commercially available SAE 15W-50 part synthetic, aviation lubricant (Comparative Example 1) was similarly tested. The results are given in Table 5.

TABLE 5

| Example Number | Viscosity Increase (cSt) |
|---|---|
| Example 3 | 22.4 |
| Example 4 | 18.0 |
| Example 5 | 15.5 |
| Comparative Example 1 | 22.8 |

As can be seen, 4 wt % Parabar 9201 is able to disperse carbon at a better efficiency than 3 wt % or 5 wt % and better than the commercially available oil.

EXAMPLE 6 AND COMPARATIVE EXAMPLES 2 AND 3

An oil having the composition of Example 1 and a 15 W–50 commercially available aviation part synthetic lubricant (Comparative Example 2) and a commercially available SAE 20W-50 aviation oil (Comparative Example 3) were tested in the inclined panel deposit test (IPDT) for 24 hours at 550° F. The IPDT is a bench test consisting of a stainless steel panel electrically heated by means of two heaters inserted into holes in the panel body. The test temperature is held at 550° F. The panel temperature is monitored using a recording thermocouple. The panel is inclined at a 4° angle and oil is dropped onto the heated panel near the top, allowing the oil to flow the length of the panel surface, drip from the end of the heated surface and be recycled to the oil reservoir. The oil forms a thin moving film which is in contact with air flowing through the test chamber. Test duration is 24 hours. Deposits formed on the panel are rated on a scale identical to that used for deposits formed in the bearing rig test (Federal Test Method Standard No. 791C, Method 3410.1). Varnish deposits rate from 0 (clean metal) to 5 (heavy varnish). Sludge deposits rate from 6 (light) to 8 (heavy). Carbon deposits rate from 9 (light carbon) to 11 (heavy/thick carbon). Higher ratings (12 to 20) are given to carbon deposits that crinkle or flake away from the metal surface during the test. The results are shown in Table 6.

TABLE 6

| Example Number | Oil Description | Rating |
|---|---|---|
| Example 6 | Example 1 | 2.8 |
| Comparative Example 2 | 15W-50 Part Synthetic Oil | 3.55 |
| Comparative Example 3 | 20W-50 Aviation Oil | 3.04 |

EXAMPLES 7 TO 9 AND COMPARATIVE EXAMPLES 4 to 6

The oil of Example 1 and the previously mentioned two commercially available aviation oils were subjected to a series of tests to evaluate rust performance. These tests were: (1) ASTM D655 Rust; (2) ASTM D1748 Humidity Cabinet Rust Test; and (3) a Modified ASTM B117 Salt Spray Rust Test.

Rust Test

The results are given in Tables 7 to 9.

TABLE 7

ASTM D665 (Water at 140° F.)

| Example Number | Oil Description | Distilled Water (24 hours) | Salt Water (24 hours) |
|---|---|---|---|
| Example 7 | Example 1 | pass | pass |
| Comparative Example 4 | Part Synthetic 15W-50 | pass | pass/fail |
| Comparative Example 5 | 20W-50 | pass/fail | fail |

TABLE 8

ASTM D1748
(120° F., Sand blasted panels, tested in triplicate)

| Example Number | Oil Description | Time to Failure |
|---|---|---|
| Example 8 | Example 1 | 168 hrs |
| Comparative Example 6 | Part Synthetic 15W-50 | 24 hrs |
| Comparative Example 7 | 20W-50 | <16 hrs |

TABLE 9

ASTM B117
(95° F., 5% salt in water, 48 hours, sand blasted panels tested in triplicate)

| Example Number | Oil Description | % Rust |
|---|---|---|
| Example 9 | Example 1 | 30 |
| Comparative Example 8 | Part Synthetic 15W50 | 47 |
| Comparative Example 9 | 20W-50 | 97 |

What is claimed is:

1. An aviation piston engine lubricant having no metal-containing additive content, the lubricant comprising:

(a) a base oil consisting essentially of a mixture of (i) at least about 50 wt % based on the total weight of the lubricant of a mineral oil base stock having a viscosity in the range of about 5 cSt to about 25 cSt at 100° C. and containing one or more mineral oils selected from solvent extracted mineral oils in the range of 150N to 600N mineral oils and mixtures thereof with solvent extracted bright stock, and (ii) about 15 to about 40 wt % based on the total weight of the lubricant of a polyalpha olefin fluid having a viscosity in the range of about 4 cSt to about 40 cSt at 100° C.;

(b) at least about 3 wt % based on the total weight of the lubricant of an ashless polyisobutylene succinic anhydride/polyamine (PIBSA/PAM) dispersant having a nitrogen content of 1.4 to 1.8% and an acid number as determined by ASTM D664-Buffer B end point of from about 5 to about 8; and (c) an effective amount of one or more ashless additives selected from the group consisting of antiwear agents, extreme pressure agents, metal passivators, and anti-oxidants.

2. The lubricant of claim 1 including from 0 to 20 ppm of an antifoam agent.

3. The lubricant of claim 2 wherein the mineral oil basestock is a blend of a solvent extracted mineral oil and a solvent extracted bright stock.

4. The lubricant of claim 2 wherein the mineral oil basestock comprises from 50 to 75 wt % of the lubricant.

5. The lubricant of claim 4 wherein the polyalpha olefin fluid comprises 20 to 30 wt % of the lubricant.

6. The lubricant of claim 5 wherein the ashless dispersant comprises 3 to 6 wt % of the lubricant.

7. The lubricant of claim 2 including viscosity index improver in an amount sufficient to provide the lubricant with a multigrade viscosity.

8. The lubricant of claim 2 including a pour point depressant.

9. The lubricant of claim 2 wherein the antiwear agent is tricresylphosphate, the antioxidant is selected from alkylated diphenyl amino, hindered phenols and mixtures thereof, the metal passivator is a benzotriazole and the extreme pressure agent is a dimercapto thiadiazole.

* * * * *